US005334288A

United States Patent [19]

Nasu et al.

[11] Patent Number: 5,334,288

[45] Date of Patent: Aug. 2, 1994

[54] PRESS ROLL IN A PAPER MACHINE

[75] Inventors: Toshiyuki Nasu, Yotsukaido; Mutsunori Kai, Noda, both of Japan

[73] Assignee: Ishikawajima-Harima Heavy Industries Co., Ltd., Tokyo, Japan

[21] Appl. No.: 942,411

[22] Filed: Sep. 9, 1992

[51] Int. Cl.[5] ..... D21F 3/08

[52] U.S. Cl. ..... 162/358.1; 492/54; 492/58

[58] Field of Search ..... 162/358.1; 492/54, 58, 492/59, 56

[56] References Cited

U.S. PATENT DOCUMENTS

| | | | |
|---|---|---|---|
| 4,272,179 | 6/1981 | Seanor | 492/58 |
| 4,704,776 | 11/1987 | Watanabe et al. | 492/54 |
| 4,963,404 | 10/1990 | Jenkins | 492/58 |
| 4,989,306 | 2/1991 | Leino et al. | 492/58 |
| 5,023,985 | 6/1991 | Salo et al. . | |
| 5,111,567 | 5/1992 | Leino et al. | 492/54 |

FOREIGN PATENT DOCUMENTS

| | | | |
|---|---|---|---|
| 0481321 | 4/1992 | European Pat. Off. . | |
| 0487477 | 5/1992 | European Pat. Off. . | |
| 2169381 | 7/1986 | United Kingdom | 162/358.1 |

*Primary Examiner*—Karen M. Hastings
*Attorney, Agent, or Firm*—Finnegan, Henderson, Farabow, Garrett & Dunner

[57] ABSTRACT

A press roll is disclosed for removing water, the press roll provided in the press portion of a paper machine. The press roll has a metal base and a sprayed coating provided on the outer surface of the metal base, at least the outer layer of the sprayed coating being a sprayed mixture of a plastics and at least one of a ceramics and a cermet. The outer surface of the plastic portion of the sprayed coating has a lapped, depressed surface relative to the outer surface of the ceramic or cermet portion.

13 Claims, 3 Drawing Sheets

PRESS ROLL IN A PAPER MACHINE

BACKGROUND OF THE INVENTION

The present invention relates to a press roll, and in particular relates to a press roll for removing water which is provided in the press portion of a paper machine, and a paper machine having the press roll.

Conventionally, a roll made of natural granite which is a so-called "stone roll", has been widely used as a press roll. However, such stone rolls are expensive due to the exhaustion of natural good-quality granite. Furthermore, the stone roll is difficult to produce and is not sufficiently strong. Therefore, recently, a roll having a plastic layer formed on the surface of a steel roll, and a spray-coated roll having a sprayed coating 2 on the outer surface of a steel roll 1 (as shown in FIG. 4) have been researched and developed so as to replace the stone roll.

However, the plastic-steel roll does not have sufficiently good performance to permit smooth release of wet paper and does not have high surface hardness; the plastic-steel roll therefore easily causes abrasion or thrust by the doctor blade which is a blade for removing bits of extraneous stock such as paper dregs adhering on the roll. Therefore, use of the plastic-steel roll cannot necessarily yield satisfactory results.

The sprayed roll has several other problems in that the sprayed coating 2 thereof is easily soiled and cleaning thereof is difficult. Furthermore, the sprayed roll does not exhibit sufficiently good. Performance to permit smooth release of wet paper, and the sprayed coating 2 is often damaged by freezing.

Oxide ceramics having high hardness, e.g., alumina, titania, zirconia or the like, have been employed for the sprayed coating 2 of the sprayed roll which has been conventionally used, taking into consideration the performance thereof so as to permit smooth release of wet paper and so as not to cause abrasion by the doctor blade. However, the sprayed coating 2 comprising such a ceramic has often voids of several μm to several 10's of μm among particles of the ceramics, the voids comprising several % to several 10's of % of the total area ratio. The voids often are interconnected in three dimensions and form deep pinholes or conduits which pass through the sprayed coating 2 from the outer surface thereof to the surface of the metal base steel roll 1.

Rosin (collophonium) or aluminium sulfate as an inhibitor of ink bleeding, i.e., a sizing agent, when printing, and a kind of loading material, e.g. , clay, talc, gypsum, barium sulfate, magnesium carbonate or the like, for improving paper quality, i.e., opacity, surface smoothness, flexibility, glossiness, density, uniformity, stretch prevention or the like, are added to the pulp liquid. Some of the particles of these additives are small enough to easily enter into the voids of sprayed coating 2. If these small particles penetrate into the voids, it is impossible to remove them because the diameter of the voids is very small. These small particles are gradually deposited in the voids, so that the deposits finally come into direct contact with the wet paper. Consequently, the performance with regard to the smooth release of wet paper deteriorates and causes problems such as breakage of the paper. There is a possibility of the failure of the sprayed coating or the peeling off thereof from the metal base by volume expansion of the pulp liquid if the pulp liquid in the voids freezes.

SUMMARY OF THE INVENTION

The present invention was developed in view of the above circumstances.

It is an object of the present invention to provide a press roll which has a good performance with respect to permitting smooth release of wet paper and can prevent the separation of the sprayed coating iron the metal base.

The press roll according to the present invention is characterized in that the press roll comprises a metal base and a sprayed coating provided on the outer surface of the metal base, at least the outer layer of the sprayed coating comprising a mixture of one or more plastics and at least one of a ceramics and a cermet.

In this case, the outer surface of the plastic portion in the outer layer of the sprayed coating is preferably depressed relative to the outer surface of the ceramic or cermet portion in the outer layer. The plastics preferably comprises a fluorocarbon resin.

DETAILED DESCRIPTION OF THE PRESENT INVENTION

An embodiment of the present invention will be explained with reference to the drawings.

Figure 1:
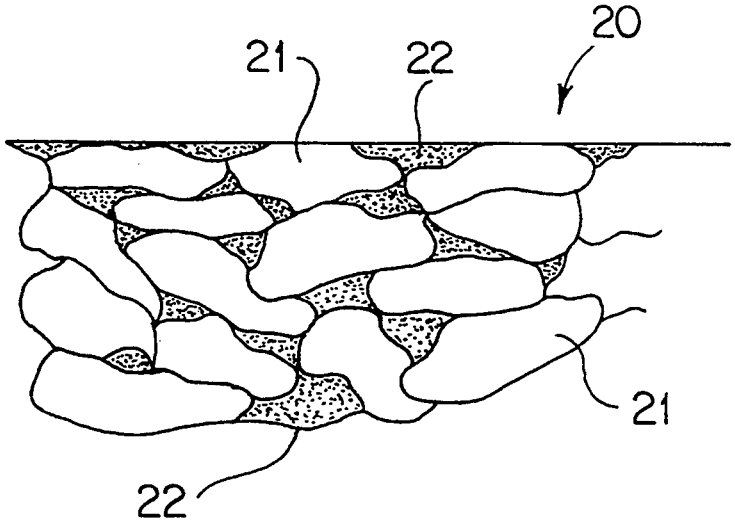
FIG. 1 is a view showing an embodiment of the sprayed coating in the press roll according to the present invention.

FIG. 1 shows a structure of a sprayed coating 20 of a press roll according to an embodiment of the present invention. The sprayed coating 20 has at least an outer layer comprising a mixture of ceramic particles 21 and plastic particles 22. In this sprayed coating, voids which are contained in the conventional sprayed coating, or channels (pinholes) which are formed by connection of the voids, are filled in by the plastic 22, so that there are no voids and no channels. The sprayed coating 20 preferably has a thickness of 2–5 min. An oxide such as $Al_2O_3$, $TiO_2$, $ZrO_2$, $SiO_2$ or the like, a carbide such as tungsten carbide (WC) or the like, a nitride such as titanium nitride (TIN) or the like, a boride such as titanium boride ($TiB_2$) or the like, a compound including at least two of the preceding components, or a cermet such as WC-Co or the like may be used as the ceramic particles 21. A fluorocarbon resin such as polytetrafluoroethylene, polytrifluoroethylene, polyvinylidene fluoride, polyvinyl fluoride or the like; a thermoplastic resin such as polyethylene, a silicone or the like; or a thermoserring resin such as an epoxy resin or the like may be used as the plastic material 22. However, it preferable to use the fluorocarbon resin as the plastic material for the reasons described hereinafter.

Figure 2:
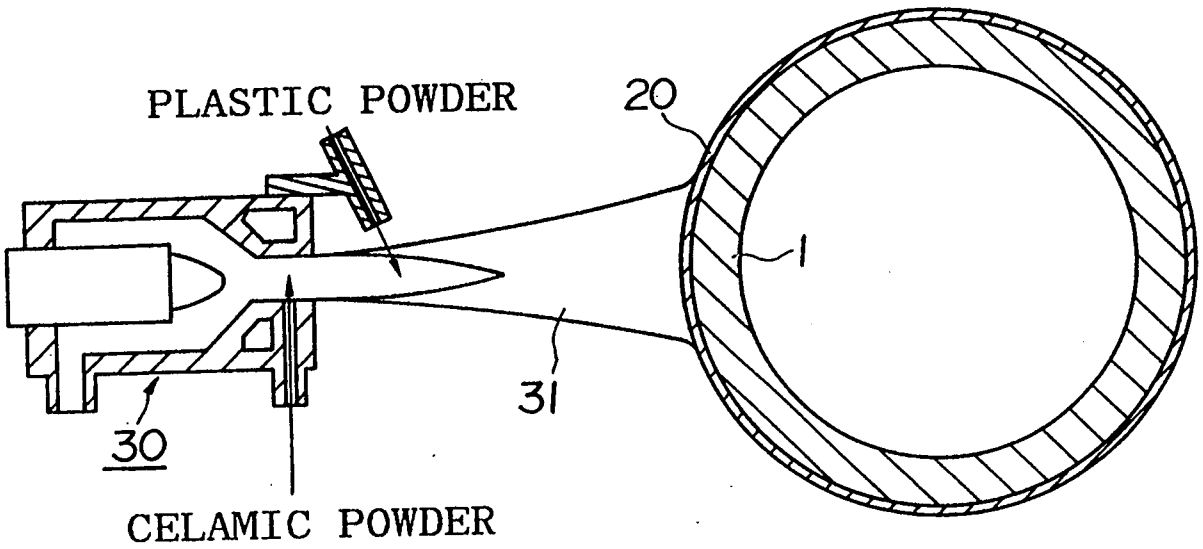
FIG. 2 is a view showing a state of forming the sprayed coating.
Figure 4:
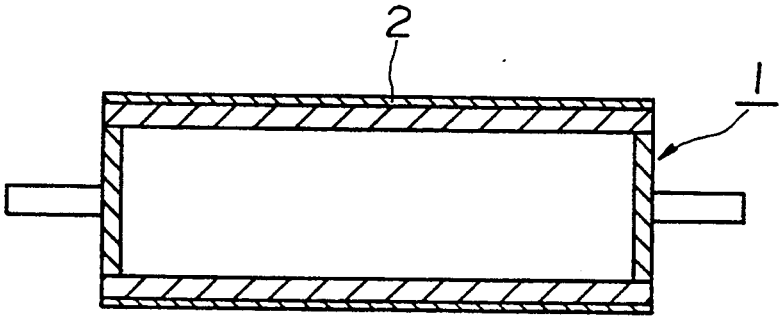
FIG. 4 is a view showing an example of a press roll having a sprayed coating on the outer surface of a steel roll.

A thermal spraying gun 30 as shown in FIG. 2, is used to apply the sprayed coating 20 with the above structure on the outer surface of the steel roll 1. It is preferable to blow ceramic powder and plastic powder into a plasma jet 31 which jets from the thermal spraying gun 30. Accordingly, these powders are instantly melted to form high-temperature liquid drops. The flow of the mixture of the liquid drops impacts at high speed on the outer surface of the steel roll 1 which is the metal base, and cools and solidifies thereon, so that a sprayed coating 20 described above is formed.

In the press roll having the sprayed coating 20 provided on the outer surface of the steel roll 1, at least the outer layer of the sprayed coating 20 comprising a mixture of ceramic particles 21 and plastic material 22, it is possible to obtain a high resistance to abrasion performance by the doctor blade by using the ceramic particles 21 with a very high hardness compared to the conventional stone roll. Furthermore, it is possible to ensure the prevention of thrust by the doctor blade, and to obtain an inexpensive roll having a high strength, in comparison with the stone roll.

The sprayed coating 20 essentially does not have any voids which are formed in the conventional sprayed coating consisting essentially of ceramic particles 21 and does not have any holes formed by connection of the voids. Therefore, there is no possibility of the pulp liquid getting into the voids or the pinholes, so that damage of the sprayed coating 20 by freezing of the pulp liquid therein does not occur. According to the structure having the sprayed coating 20, it is possible to prevent lowering of the performance with respect to permitting smooth release of wet paper by deposition of the sizing agent or the loading material in the voids or the holes.

It is possible to adjust the ratio of the exposed area of the ceramic particles 21 to that of the plastic material 22 on the surface of the sprayed coating 20 by adjusting the blending ratio of the ceramic particles 21 and the plastic material 22. Thereby, it is possible to obtain a press roll having surface characteristics suitable for various kinds of paper and for various paper quality. When the outer layer portion of the sprayed coating 20 is worn out, it is possible to renew the press roll by re-polishing so as to have a surface structure similar to that of the original press roll.

It is possible to use a fluorocarbon resin as the plastic material; the use of the fluorocarbon resin improves the characteristics of the surface of the press roll with respect to smooth release of wet paper. The fluorocarbon resin is one of the most stable plastics among various kinds of plastics; that is, the fluorocarbon resin has characteristics of excellent acid-resistance and of excellent alkali-resistance, does not absorb water is not damaged by various kinds of chemicals or solvents, has characteristics of high heat-resistance and of high water and oil repellency, i.e., the contact angle thereof to a liquid is larger than that of other plastics. Therefore, this type of press roll is most suitable as a press roll for a paper machine.

Figure 3:
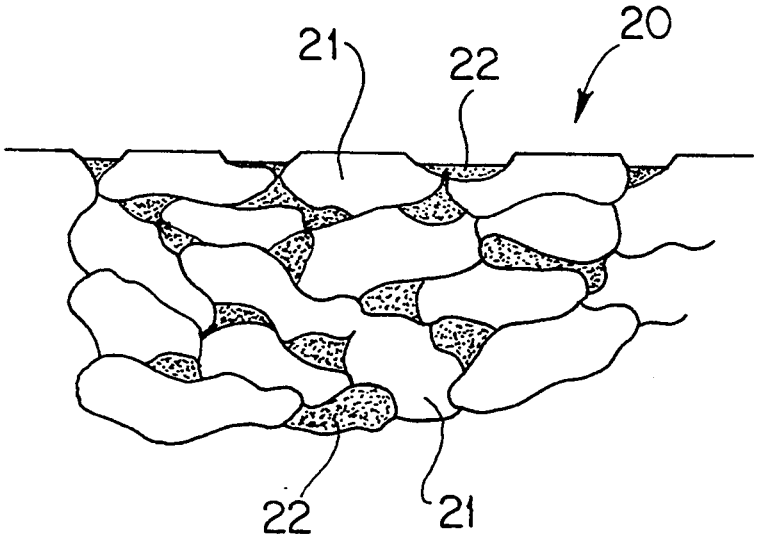
FIG. 3 is a view showing another embodiment of the sprayed coating.

It is possible to depress the outer surface of the plastic portion in the outer layer of the sprayed coating relative to the outer surface of the ceramic portion in the outer layer as shown in FIG. 3 by carrying out a lapping treatment to the surface of the sprayed coating 20 after an ordinary polishing treatment so that the plastic material 22 having a lower hardness than that of the ceramic particles is selectively polished by the lapping material. Thereby, the depressed portion of the plastic material forms air pockets to further improve the characteristics of the surface of the press roll with respect to smooth release of wet paper.

In the press roll of the present invention, at least the outer layer of the sprayed coating may comprise a mixture of ceramic particles 21 and a plastic material 22. That is, the entire sprayed coating may comprise the mixture, however, the sprayed coating may comprise the outer layer thereof as a mixture and the inner layer thereof may be a single coating of a ceramics.

In the above embodiment, only a press roll having the outer layer of the sprayed coating comprising a mixture of a plastic material and ceramic particles has been described. However, the press roll of the present invention may have the outer layer of the sprayed coating comprising a mixture of a plastic material and cermet particles. Accordingly, it is possible to obtain similar effects according to the use of the mixture of the plastic material and the ceramic particles 21.

As described above, the press roll according to the present invention comprises a metal base and a sprayed coating provided on the outer surface of the metal base, at least the outer layer of said sprayed coating comprising a mixture of a plastics and at least one of a ceramics and a cermet. Therefore, it is possible to obtain high resistance to abrasion performance by using the ceramic particles 21 and to obtain an inexpensive roll having a high strength in comparison with a stone roll. Furthermore, the sprayed coating of the press roll according to the present invention substantially does not have voids which are formed in the conventional sprayed coating consisting essentially of ceramic particles and does not have any pinholes which are formed by connection of the voids. Therefore, there is no possibility of the pulp liquid getting into the voids or the holes, so that damage of the sprayed coating by freezing of the pulp liquid therein does not occur, and it is therefore possible to prevent lowering of the performance to permit smooth release of wet paper by deposit ion of the sizing agent or the loading material in the voids or the holes. It is possible to obtain a press roll having a surface characteristic suitable for various kinds of paper or paper quality by adjusting the diameter of the ceramic particles or the like and the blending ratio of the ceramic particles and the plastic material. When the outer layer portion of the sprayed coating is worn out, it is possible to renew the press roll to one having a surface structure similar to that of the original press roll simply by repolishing.

In particular, by depressing the outer surface of the plastic portion in the outer layer of said sprayed coating relative to the outer surface of the ceramic or cermet portion in the outer layer, the depressed portion of the plastic material forms an air pocket to improve the characteristics of the surface of the press roll with respect to smooth release of wet paper. Use of a fluorocarbon resin as the plastic material improves the characteristics of the surface of the press roll with respect to smooth release of wet paper in comparison with use of other plastic materials. Therefore, this type of press roll is most suitable as a press roll for a paper machine.

The press roll described in the above embodiment can be used for a conventional paper machine. According to the paper machine of the present invention, it is possible to improve the characteristics with respect to smooth release of wet paper.

What is claimed is:

1. A press roll in a paper machine comprising a metal base and a sprayed coating provided on an outer surface of said metal base, at least an outer layer of said sprayed coating comprising a sprayed mixture of a plastics and at least one of a ceramics and a cermet, an outer surface of the plastic portion of said sprayed coating having a lapped, depressed surface relative to the outer surface of the ceramic or cermet portion.

2. A press roll as claimed in claim 1, wherein the outer layer of said sprayed coating comprises a sprayed mixture of a plastics and a ceramics, the ceramics in the outer layer of said sprayed coating comprising a component selected from the group consisting of an oxide, a carbide, a nitride, a boride, and a compound including at least two the preceding components.

3. A press roll as claimed in claim 1, wherein the outer layer of said sprayed coating comprises a sprayed mixture of a plastics and a ceramics, the ceramics in the outer layer of said sprayed coating comprising a component selected from the group consisting of $Al_2O_3$, $TiO_2$, $ZrO_2$, $SiO_2$, WC, TiN, $TiB_2$, and a compound including at least two of the preceding components.

4. A press roll as claimed in claim 1, wherein the outer layer of said sprayed coating comprising a sprayed mixture of a plastics and a cermet, the cermet in the outer layer of said sprayed coating comprising WC-Co.

5. A press roll as claimed in claim 1, wherein said plastics comprises a thermoplastic resin selected from the group consisting of a fluorocarbon resin, polyethylene, and a silicone.

6. A press roll as claimed in claim 5, wherein said thermoplastic resin comprises a fluorocarbon resin selected from the group consisting of polytetrafluoroethylene, polytrifluoroethylene, polyvinylidene fluoride, and polyvinyl fluoride.

7. A paper machine comprising a press roll for removing water from wet paper, which is provided in a press portion thereof, the press roll comprising a metal base and a sprayed coating provided on an outer surface of said metal base, at least an outer layer of said sprayed coating comprising a sprayed mixture of a plastics and at least one of a ceramics and a cermet, an outer surface of the plastic portion of said sprayed coating having a lapped, depressed surface relative to the outer surface of the ceramic or cermet portion.

8. A paper machine as claimed in claim 7, wherein the outer layer of said sprayed coating comprises a sprayed mixture of a plastics and a ceramics, the ceramics in the outer layer of said sprayed coating comprising a component selected from the group consisting of an oxide, a carbide, a nitride, a boride, and a compound including at least two of the preceding components.

9. A paper machine as claimed in claim 7, wherein the outer layer of said sprayed coating comprises a sprayed mixture of a plastics and a ceramics, the ceramics in the outer layer of said sprayed coating comprising a component selected from the group consisting of $Al_2O_3$, $TiO_2$, $ZrO_2$, $SiO_2$, WC, TiN, $TiB_2$, and a compound including at least two of the preceding components.

10. A paper machine as claimed in claim 7, wherein the outer layer of said sprayed coating comprises a sprayed mixture of a plastics and a cermet, the cermet in the outer layer of said sprayed coating comprising WC-Co.

11. A paper machine as claimed in claim 7, wherein said plastics comprises a thermoplastic resin selected from the group consisting of a fluorocarbon resin, polyethylene, and a silicone.

12. A paper machine as claimed in claim 11, wherein said thermoplastic resin comprises a fluorocarbon resin selected from the group consisting of polytetrafluoroethylene, polytrifluoroethylene, polyvinylidene fluoride, and polyvinyl fluoride.

13. A press roll in a paper machine comprising a metal base and a sprayed coating provided on an outer surface of said metal base, at least an outer layer of said sprayed coating comprising a sprayed mixture of a plastics and at least one of a ceramics and a cermet, wherein said sprayed coating has a structure formed by spraying a high-temperature liquid mixture comprising a plastics and at least one of a ceramics and a cermet on the outer surface of said metal base., an outer surface of the plastic portion of said sprayed coating having a lapped, depressed surface relative to the outer surface of the ceramic or cermet portion.

* * * * *

UNITED STATES PATENT AND TRADEMARK OFFICE

CERTIFICATE OF CORRECTION

PATENT NO. : 5,334,288

DATED : August 02, 1994

INVENTOR(S) : Toshiyuki Nasu et al

It is certified that error appears in the above-indentified patent and that said Letters Patent is hereby corrected as shown below:

Claim 2, Column 5, Line 7 after "two" insert --of--.

Claim 13, Column 6, Line 36 after "base" delete --.--.

Signed and Sealed this

Third Day of January, 1995

Bruce Lehman

*Attest:*

BRUCE LEHMAN

*Attesting Officer*

*Commissioner of Patents and Trademarks*